United States Patent [19]

Cherney

[11] Patent Number: 4,860,522

[45] Date of Patent: Aug. 29, 1989

[54] FORM, FILL AND SEAL REGISTRATION SYSTEM APPARATUS AND METHOD INCLUDING VARIABLE LENGTH COMPENSATION AND OUT OF REGISTRATION RESTORATION

[75] Inventor: Dale M. Cherney, Howards Grove, Wis.

[73] Assignee: Hayssen Manufacturing Company, Sheboygan, Wis.

[21] Appl. No.: 208,687

[22] Filed: Jun. 20, 1988

[51] Int. Cl.[4] ..... B65B 57/04; B65B 9/08; B65B 9/20

[52] U.S. Cl. ..... 53/451; 53/479; 53/51; 53/64; 53/75; 53/551

[58] Field of Search ..... 53/451, 479, 551, 552, 53/64, 66, 51, 75, 389

[56] References Cited

U.S. PATENT DOCUMENTS

| | | | |
|---|---|---|---|
| 3,262,349 | 7/1966 | Hollenton et al. | 53/51 X |
| 3,673,418 | 6/1972 | Wiig | 53/51 UX |
| 4,081,944 | 4/1978 | Sjöstrand | 53/51 |
| 4,288,965 | 9/1981 | James | 53/551 X |
| 4,316,566 | 2/1982 | Arleth et al. | 53/51 X |
| 4,391,079 | 7/1983 | Cherney | 53/396 |
| 4,680,205 | 7/1987 | Lerner et al. | 53/51 X |
| 4,727,707 | 3/1988 | Hadden | 53/51 X |
| 4,744,202 | 5/1988 | Wylie | 53/51 X |
| 4,754,593 | 7/1988 | Ishihara et al. | 53/551 X |

*Primary Examiner*—Horace M. Culver

*Attorney, Agent, or Firm*—Senniger, Powers, Leavitt and Roedel

[57] ABSTRACT

A control system and method for an apparatus for sealing packages wherein a web of flexible packaging material having a series of registration marks is formed into tubing and fed past a sealing device for sealing the tubing to form packages. As the tubing is fed past the sealing device, a photoeye detects the registration marks. A CPU, responsive to the photoeye, compares the location of registration marks relative to a window. A counter, responsive to the CPU, sets a delay length of tubing to be fed past the sealing device in response to the relative location of the registration marks and the window. The feeding of the tubing is stopped after the counter has been decremented to zero and the delay length of tubing has passed the sealing device. An in registration delay length of tubing to be fed past the sealing device is set in response to detection by said photoeye of a registration mark within the window. An out of registration delay length to be fed past the sealing device is set in response to failure of the photoeye to detect a registration mark within the window. The feeding of the tubing is stopped after the in registration delay length of tubing has passed the sealing device to allow sealing of the tubing at that point. The feeding of the tubing is also stopped in response to failure by the photoeye to detect a registration mark during the period that the out of registration delay length is fed past the sealing device. The in registration delay length has a magnitude which is a function of the relative location.

76 Claims, 12 Drawing Sheets

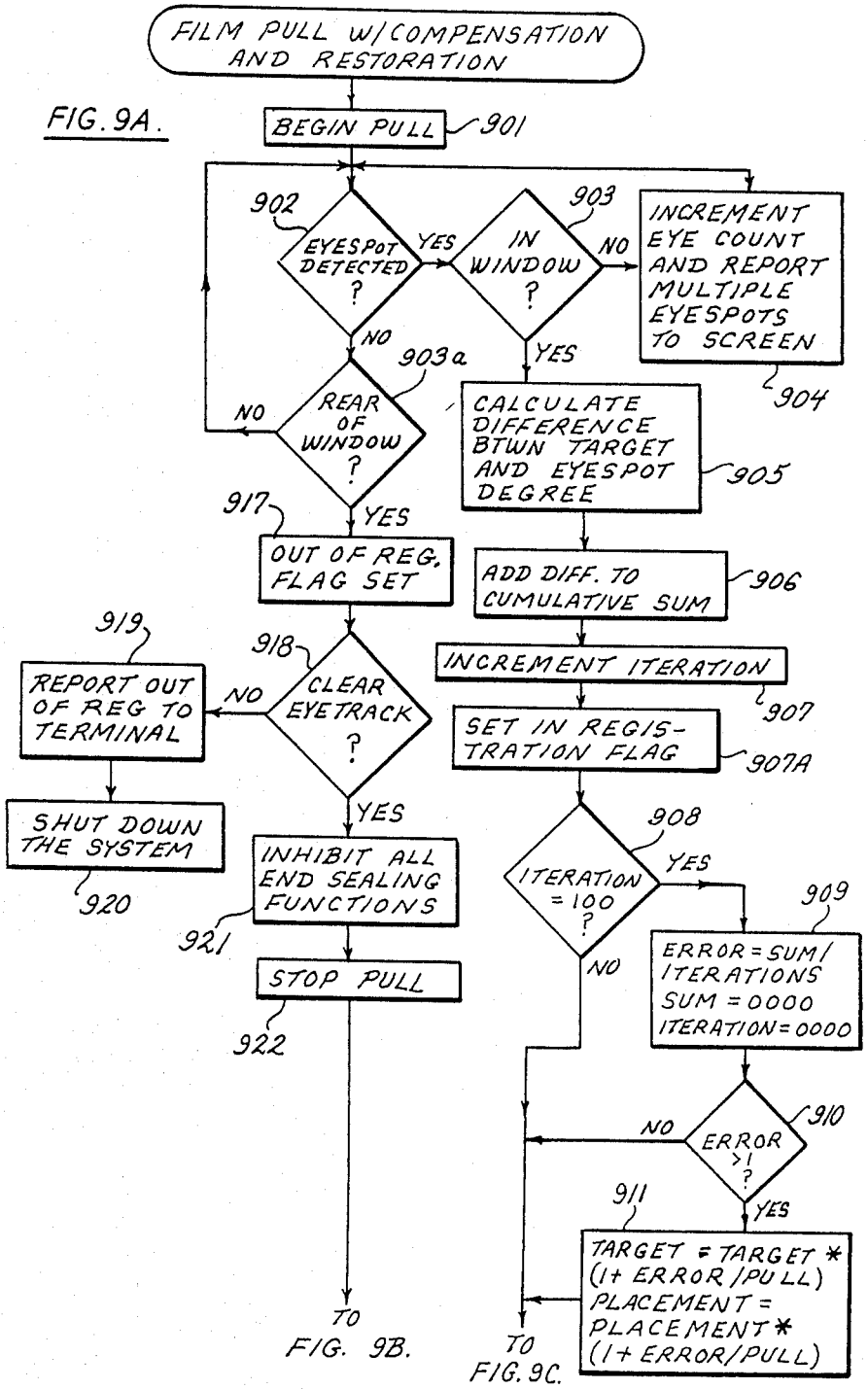
FILM PULL W/COMPENSATION AND RESTORATION
FIG. 9A.
BEGIN PULL
901
902
EYESPOT DETECTED ?
YES
NO
903
IN WINDOW ?
NO
YES
INCREMENT EYE COUNT AND REPORT MULTIPLE EYESPOTS TO SCREEN
904
903a
REAR OF WINDOW ?
NO
YES
CALCULATE DIFFERENCE BTWN TARGET AND EYESPOT DEGREE
905
917
OUT OF REG. FLAG SET
ADD DIFF. TO CUMULATIVE SUM
906
919
REPORT OUT OF REG TO TERMINAL
918
CLEAR EYETRACK ?
NO
YES
INCREMENT ITERATION
907
SET IN REGIS-TRATION FLAG
907A
SHUT DOWN THE SYSTEM
920
INHIBIT ALL END SEALING FUNCTIONS
921
908
ITERATION = 100 ?
YES
NO
909
ERROR = SUM/ ITERATIONS
SUM = 0000
ITERATION = 0000
STOP PULL
922
910
ERROR >1 ?
NO
YES
911
TARGET = TARGET * (1+ ERROR/PULL)
PLACEMENT = PLACEMENT * (1+ ERROR/PULL)
TO FIG. 9B.
TO FIG. 9C.

FORM, FILL AND SEAL REGISTRATION SYSTEM APPARATUS AND METHOD INCLUDING VARIABLE LENGTH COMPENSATION AND OUT OF REGISTRATION RESTORATION

BACKGROUND OF THE INVENTION

This invention relates to control systems for machines and more particularly to control systems for cyclic machines (i.e. for machines which are operable in cycles).

Typically, cyclic machines carry out a number of functions during each cycle, each of which must start at a predetermined stage of the machine in its cycle (which stage may or may not be unique for each function) and stop at a second predetermined stage in the machine cycle (which again may or may not be unique for each function). These functions often are interrelated, and thus it is important that they start and stop as nearly as possible at the predetermined stages in the machine cycle. Cycle rates of 100, 200 or even 300 cycles/minute are not uncommon. At these rates, accurate control of several functions during each cycle is difficult.

For many years, control systems have used rotary cam actuated limit switches for controlling machine functions. But this requires that a fairly large number of cams be accurately positioned to strike the limit switches at precise stages in the machine cycle. Adjustment of the cams and switches is difficult. And failure after prolonged use is common because of mechanical wear and electrical deterioration of the switches. Particularly at higher cycle rates, cam based systems are unsatisfactory Solid state control systems have been developed to address some of these problems, but present ones also have disadvantages. Foremost among these disadvantages is cost. Solid state control systems are relatively expensive to purchase. In addition some of these systems require additional programming before they can be used with a particular type of machine, which can also be expensive.

A second disadvantage of solid state control systems is that some are too complex for many machines, particularly for machines having only a relatively small number of functions and requiring only limited logic capability. For example, the packaging industry uses form, fill and seal machines which have only a few (e.g., six) functions to be controlled. Such functions might include the feeding of flexible packaging material to the machine, pulling or feeding the packaging material over a mandrel to form tubing and past a sealing station, opening and closing sealing bars or dies at the sealing station to form packages, cutting the packages apart, signalling a product feeding apparatus to feed more product to be packaged, etc. Such a machine is shown in coassigned U.S. Pat No. 4,288,965. These functions can be controlled by timers and in the case of a vertical form, fill and seal machine nine to twelve timers would be sufficient. Doing this causes an additional problem, however, whenever the speed of the machine is changed. When this happens all the timers must be readjusted In fact, machine speed is usually not constant but instead varies over some small range which means that the timing of the functions will never be exactly right even at a nominally constant speed. This problem can be solved by making the machine speed truly constant, but this is expensive.

Previous form, fill and seal machines inhibited the operation of various functions to ensure that the functions occurred in proper order with respect to each other and with respect to the feeding of product to the machine. Concerning the latter, product feed is often an asynchronous operation with respect to the packaging machine As a result, previous machines sometimes have had to skip a cycle (which is called a "dry cycle") because the product at that particular time is not being supplied to the packaging machine at a high enough rate.

Another group of problems with previous form, fill and seal machines occurs when packaging material having registration marks is used to make packages Generally, these registration marks (call "eyespots") are spaced at package length intervals along the material. If for some reason one of these registration marks is not detected by the machine, the machine quickly gets out of registration with the material at the proper point, i.e., within a predefined window. This is a problem with printed packaging material. If the out of registration condition continues for several cycles, total loss of registration can result.

Another problem with printed packaging material is that the machine may mistake some of the printing for an eyespot, which again causes registration to be lost. A third problem, peculiar to a certain type of packaging machine, namely those having a "fixed eye" for detecting the registration marks, concerns synchronizing the sealing of a package with the detection of an eyespot. With a movable detector, the detector can simply be moved by the operator during setup of the machine for a particular run of material until the sealing occurs at the proper place. With a machine having a "fixed eye", this is not always possible Although "fixed eyes" can often be moved a few inches along the path of the packaging material, this is often not enough to permit sealing of the packages at the required spot. One possible solution to this problem is to provide a preset time delay between the detection of an eyespot and the sealing of the package Doing this causes yet another problem, viz. a change in machine speed will cause the length of material fed past the sealing station during the preset time delay to vary, causing loss of registration.

SUMMARY OF THE INVENTION

Accordingly, among the several objects of this invention may be noted the provision of a method of and apparatus for accurately controlling functions of a cyclic machine; the provision of such a method and apparatus which eliminates the need for rotary cam actuated limit switches; the provision of such a method and apparatus which uses solid state components; the provision of such a method and apparatus which minimizes set-up and programming cost; the provision of such a method and apparatus which is suited for cyclic machines having a relatively small number of functions and requiring only limited logic capability; the provision of such a method and apparatus which controls the various functions without operator intervention; the provision of such a method and apparatus which accurately controls the various functions even though the machine speed is not a constant; the provision of such a method and apparatus for use with packaging machines which keeps the packaging material in proper registration; and the provision of such a method and apparatus for use with packaging machines which solves the problem of mistaking printed matter on the packaging material for the registration marks.

In one form, the invention comprises a control system for an apparatus for sealing packages wherein a web of flexible packaging material having a series of registration marks is formed into tubing and fed past sealing means for sealing the tubing to form packages. Means feeds the tubing past the sealing means. Sensor means detects the registration marks. Means, responsive to the sensor means, compares the location of registration marks relative to a window. Delay means, responsive to the comparing means, sets a delay length of tubing to be fed past the sealing means in response to the relative location of the registration marks and the window. Means stops the feeding of the tubing after the delay length of tubing has passed the sealing means. The delay length may have a magnitude which is a function of the relative location.

In another form, the invention comprises a control method for sealing packages wherein a web of flexible packaging material having a series of registration marks is formed into tubing and fed past sealing means for sealing the tubing to form packages. The tubing is fed past the sealing means and the registration marks are detected In response to the detecting step, the location of registration marks relative to a window is compared. In response to the comparing step, a delay length of tubing to be fed past the sealing means is set in response to the relative location of the registration marks and the window. The feeding of the tubing is stopped after the delay length of tubing has passed the sealing means. The delay length has a magnitude which is a function of the relative location.

Other objects and features will be in part apparent and in part pointed out hereinafter.

BRIEF DESCRIPTION OF THE DRAWINGS

FIGS. 9A, 9B and 9C are decision flow charts in block diagram form illustrating the method of operation of a form, fill and seal registration system apparatus according to the invention for registered film having registration marks Corresponding reference characters indicate corresponding parts throughout the several views of the drawings.

DETAILED DESCRIPTION OF PREFERRED EMBODIMENTS

Figure 1:
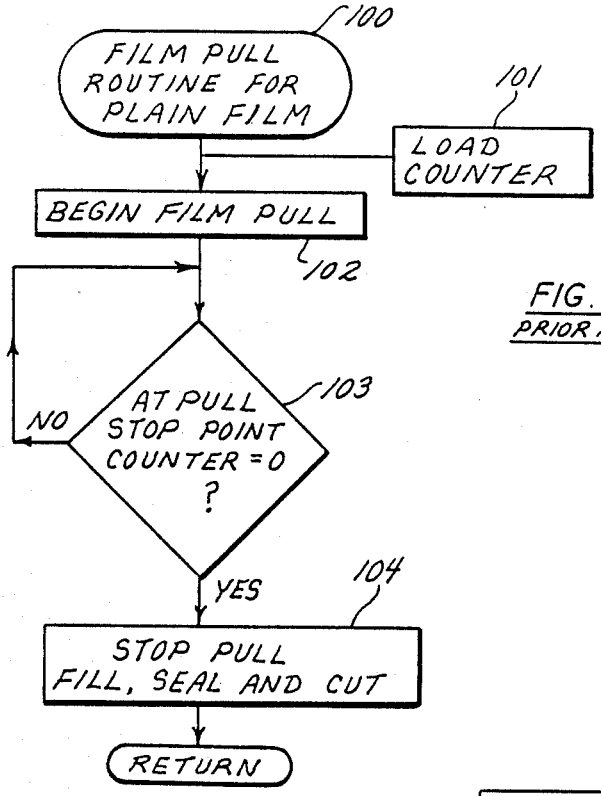
FIG. 1. PRIOR ART
FIG. 1 is a flow chart in block diagram form illustrating the operation of a form, fill and seal registration system apparatus and method according to the prior art for plain film having no registration marks.

FIG. 1 depicts the prior art steps involved in forming, filling and sealing a plain film which has no registration marks. In general, a counter is associated with the pulling apparatus so that the count within the counter represents the length of the pull. This method is generally titled Film Pull Routine for Plain Film as indicated by reference character 100. First step 101 involves loading the counter with a count corresponding to the length of the pull. In step 102 the pull is initiated by energizing the appropriate hardware which initiates the film pull. As the film is pulled, the counter begins decrementing in synchronization with the film pull so that the count in the counter at any instant in time represents the length of the pull. The pull stop point is the point at which the counter equals zero and has completed counting In step 103, the counter is continuously queried until it has decremented to zero at which point step 104 is initiated to stop the pull. Thereafter, the formed film is filled, sealed and cut. After step 104 is completed, the procedure is repeated.

Figure 2:
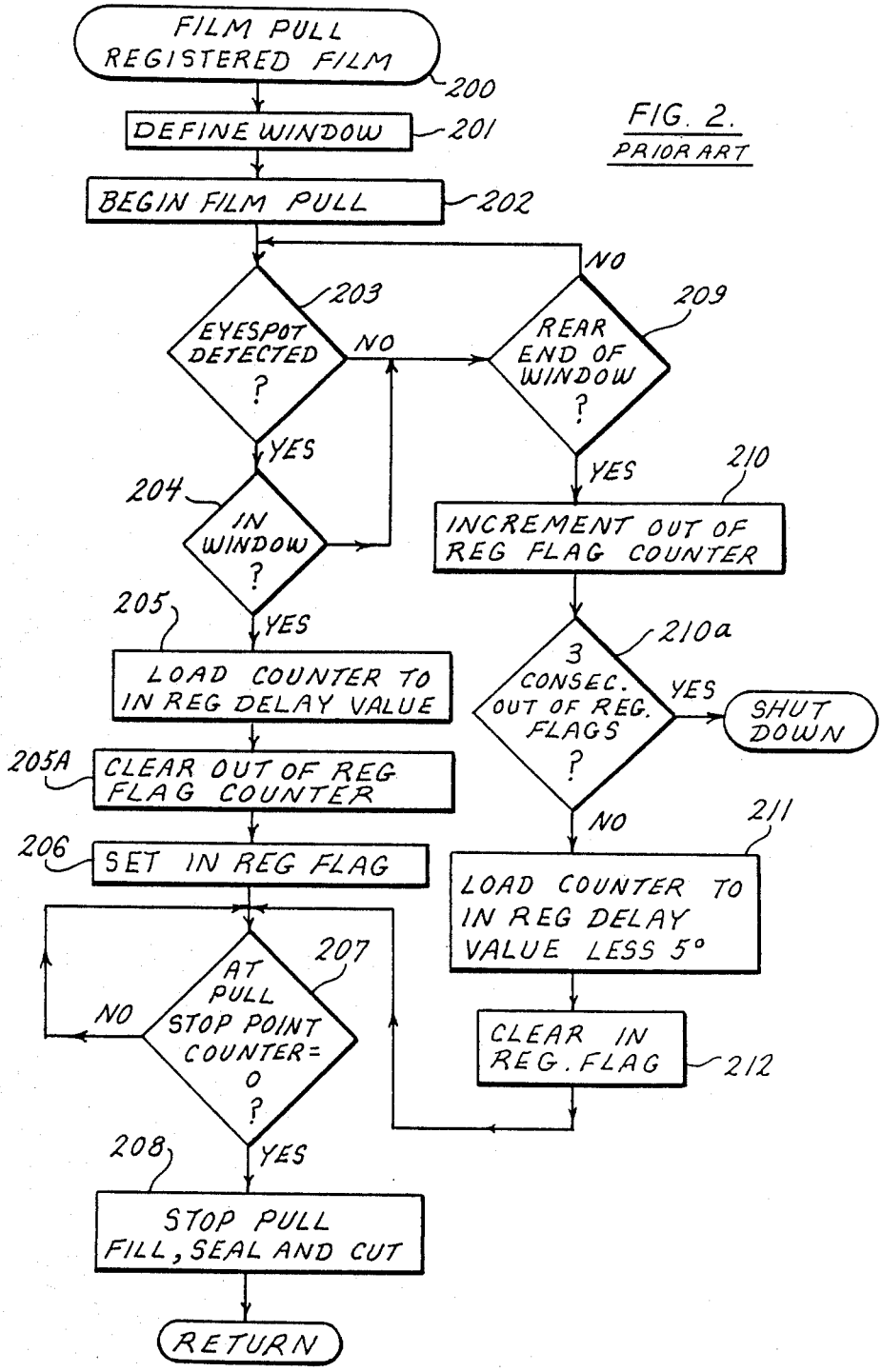
FIG. 2. PRIOR ART
FIG. 2 is a flow chart in block diagram form illustrating the operation of a form, fill and seal registration system apparatus and method according to the prior art for registered film having registration marks.

FIG. 2 depicts a prior art film pull for a registered film as labeled by reference character 200. In this procedure, a period of machine pull time such as a window is defined within which an eyespot or registration mark is expected to occur. The window may be a specific period of time during which registration marks are being detected or may be defined by a range of counts during which registration marks are being detected and the particular eyespot is expected to be detected. Step 201 involves the defining of the window. Thereafter, step 202 is initiated so that the film pull begins. During the film pull, a sensor such as a photoeye is used to detect the eyespots which generally are located along the edge of the film. This process is known in the prior art such as described in coassigned U.S. Pat. Nos. 4,288,965 and 4,391,079, both of which are incorporated herein by reference.

As the film pull is begun by step 202, the eyespot sensor begins detecting eyespots and, in particular, looks for an eyespot within the window. If an eyespot is detected within the window, regardless of the position of the eyespot within the window, the counter is loaded. In particular, if the sensor detects an eyespot as indicated by step 203 and the eyespot is within the window as indicated by step 204, the counter is loaded with a placement value which is the number of counts (or degrees or length increments) which are delayed following the detection of an eyespot and before the film pull is stopped for filling, sealing and cutting (step 205). The counter signifying out of registration cycles is then set equal to zero by step 205A. Thereafter, the in-registration flag is set by step 206 signifying that the eyespot has been detected in the window. Step 207 is then carried out and the counter is monitored until it equals zero indicating that the pull stop point of the film has been reached. Thereafter, the film pull is stopped by step 208, the formed film is filled, sealed and cut and the film pull begins again.

Referring back to step 203, if no eyespot has been detected yet, step 209 is performed to determine whether the rear of the window has been reached. If the rear of the window has not been reached, eyespot detection by step 203 continues. If an eyespot is detected by step 203 but the eyespot is determined to be outside the window by step 204, step 209 is also performed to ensure that the end of the window has not been reached, i.e., the eyespot is before the window. If an eyespot is detected before the window, the process returns to step 203 to search for another eyespot within the window. If, on the other hand, the end of the window has been reached and no eyespot within the window has been detected, the system is in an out of registration condition because no eyespot has been detected within the window. Therefore, step 210 is performed to increment the out of registration flag counter. At this point, the counter is checked at step 210*a* to see if it is at a preset maximum number of out of registration cycles (3 in this case). If it is, the system will shut down as indicated. If the terminal count is not reached, the counter is loaded as though the eyespot had been detected in the center of the window and it was simply missed. In particular, step 211 is performed to load the counter with the in registration delay length less half the window width (5°). The film pull proceeds as the counter is decremented. In the meantime, step 212 is executed to clear the in-registration flag. In this scheme, a limited number of out of registration flags are permitted to be set before the system is totally shut down. For example, up to two out of registration bags may be allowed so that step 210*a* will be activated to shut down the system only if the out of registration flag has been set three consecutive times by step 210.

After step 212 clears the in-registration flag, the counter is monitored by step 207 until it has decremented to zero at which point the film pull is stopped and step 208 is performed to fill, seal and cut the film. The procedure of FIG. 2 is then executed again.

It can be seen from the above description that, should the film length change during the run, there will be a shift of the eyespot in the window and there is a possibility f having an eyespot which is detected outside the window. This would mean that the film would no longer be in registration. If this out of registration condition continues for more than three cycles, the process would automatically be shut down by step 210*a*. In the registered film mode, the pull length is generally adjusted to be about one-half inch longer than the plain pull length. This adjustment is required to allow flexibility in the pull length to enable the system to achieve registration under varying conditions of bag length, eyespot position on the film and print variations. Form, fill and seal registration system apparatus and method according to the invention includes variable length compensation and out of registration restoration, features which are not part of the prior art as illustrated by FIGS. 1 and 2.

Figure 3:
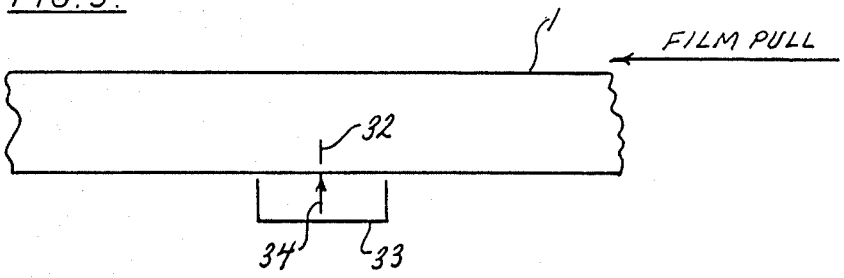
FIG. 3 is a schematic diagram illustrating a constant length film in registration wherein the detected registration mark is within the window and at the target point.
Figure 4:
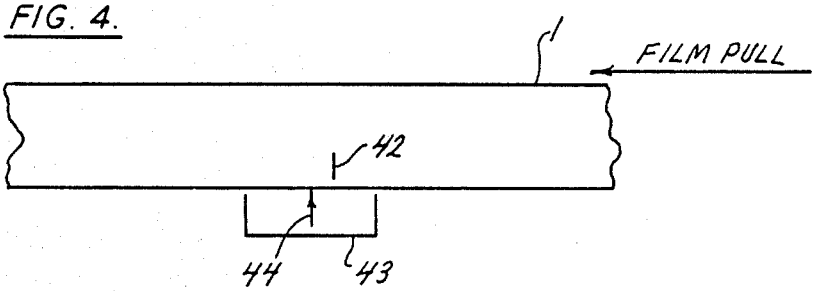
FIG. 4 is a schematic diagram illustrating a varying length film in registration wherein the detected registration mark is within the window but not at the target point.
Figure 5:
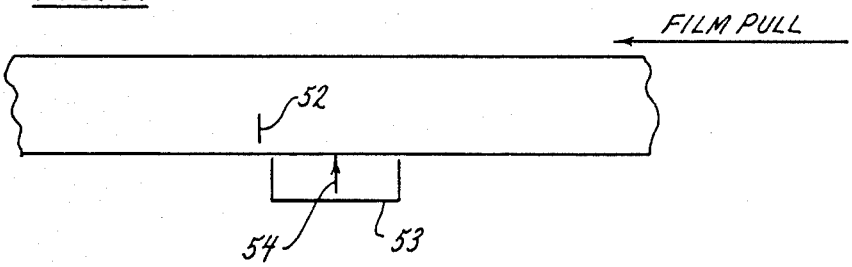
FIG. 5 is a schematic diagram illustrating a film out of registration or in lost registration wherein the detected registration mark is not within the window.

FIGS. 3, 4 and 5 illustrate film 1 having eyespot 32,42,52 being detected within window 33,43,53 having a central target point 34,44,54. FIG. 3 illustrates eyespot 32 within window 33 and in registration at target point 34. This occurs when the bag length is constant and results in a constant length for the individually sealed packages. FIG. 4 illustrates eyespot 42 in registration by being within window 43 but not at the desired target point 44. This is caused by a varying bag length and results in shifted graphics. FIG. 5 illustrates an out of registration condition or a lost registration condition wherein eyespot 52 is detected outside of widow 53 and not in registration. This out of registration condition also results if no eyespot is detected.

Figure 6A:
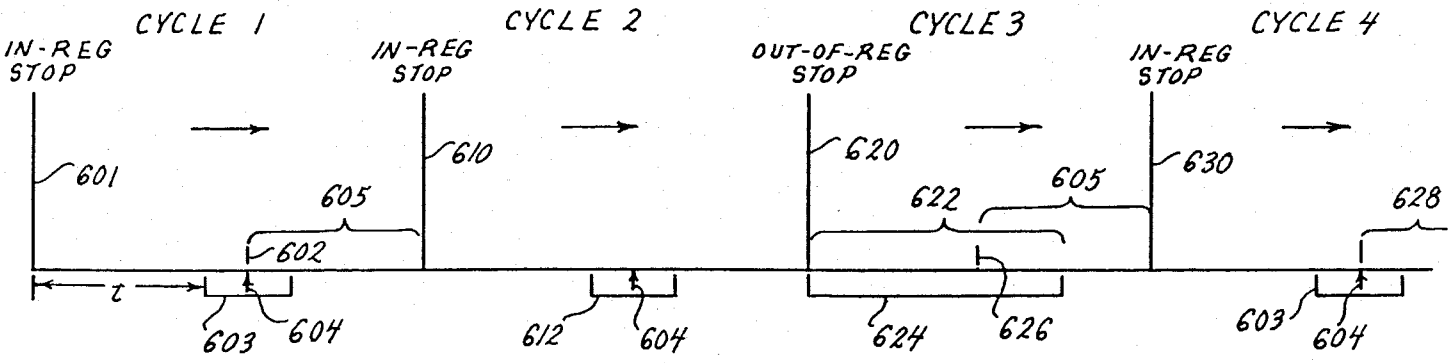
FIG. 6A is a time line illustration of the events resulting from the use of the registration system including the out of registration restoration procedures of the invention wherein the film becomes out of registration and registration is recaptured.

FIG. 6A illustrates a time line of events which would result from the use of the registration system according to the invention, including the out of registration restoration procedures. Proceeding from left to right, FIG. 6A illustrates the various conditions which result from a film becoming out of registration and then registration being recaptured so that the film is in registration again. A vertical line indicates the end of a cycle at which point the feeding of the film is stopped, the bag formed from the film is filled with product and sealed and the seal is cut.

In general, one embodiment of the invention relates to a method for sealing packages wherein a web of flexible packaging material having a series of registration marks is formed into tubing. The tubing is fed past a sealing means which seals the tubing to form the packages. The invention particularly relates to an improved control method of this type.

Cycle 1 begins immediately after the film is stopped, filled, sealed and cut as indicated by reference character 601. Thereafter, the first step involves initially feeding the tubing past the sealing means. As the tubing is fed past the sealing means, registration marks on the tubing are detected. Generally, such registration marks take the form of eyespots located along the edge of the tubing. Such registration marks may be detected by a photoeye or other detecting sensor. Upon detection of eyespot 602, the location of eyespot 602 is compared to the location of in-registration window 603 and particularly to target location 604 located in the center of window 603.

In response to this comparison, an in-registration delay length (placement) is set which represents the length of tubing to be fed past the sealing means in response to the relative location of registration mark 602 and target location 604 of in-registration window 603. In cycle 1 as illustrated in FIG. 6A, eyespot 602 appears directly opposite the desired target location 604 within window 603 so that the film is considered to be in registration. As a result, in-registration delay length 605 is set to run from the time that eyespot 602 is detected opposite target location 604. In-registration delay length 605 is a count loaded into a counter as noted above or may simply be a timer which provides a timing signal directly related to the speed of the feeding of the film. At the end of the in-registration delay length 605, the feeding of the tubing is stopped. In other words, this constitutes the step of stopping the feeding of the tubing after the in-registration delay length 605 of the tubing has passed the sealing means. At point 610, the feeding of the tubing (or film) is stopped, the tubing is filled, sealed and cut and the next cycle begins.

During cycle 2 of FIG. 6A, no eyespots are detected. As a result, the end of in-registration window 612 is reached and the sensor detecting the registration marks has been unable to identify an eyespot. In this situation, the invention includes the step of stopping the feeding of the tubing some time after the end of the window 612 to allow sealing of the tubing in the event that the detecting step fails to detect a registration mark within the window. Since no eyespot appeared opposite in-registration window 612, the second cycle ends by stopping the feeding of the tubing, filling the tubing, and back sealing it as indicated by point 620. No end seal or cutoff is performed at this time.

At this point, the invention includes in cycle 3 the step of setting an out of registration delay length to be fed past the sealing means in the event that the detecting step fails to detect a registration mark within the delay period. Since no registration marks were detected within in-registration window 612 during cycle 2, an out of registration delay length 622 is set to begin running immediately after point 620 in cycle 3. This out of registration delay length 622 also corresponds to an out of registration window 624. During the out of registration delay length 622 (or out of registration window 624), the system continues to search for eyespots. When eyespot 626 is detected, the system returns to the step of setting an in-registration delay length 605 to be fed past the sealing means in response to the relative location of eyespot 626 and out of registration window 624. The step of stopping the feeding of the tubing after said in-registration delay length of tubing has passed the sealing means is repeated at point 630 and cycle 4 is commenced. Cycle 4 then proceeds in the same manner as cycle 2. Both cycles 1 and 3 include the step of setting an in-registration delay length of tubing to be fed past the sealing means in the event that a registration mark is detected within the window. The difference between cycles 1 and 3 in this regard is that in cycle 1 the eyespot 602 is detected within in-registration window 603 whereas in cycle 3 eyespot 626 is detected within out of registration window 624. In either case, in-registration delay length 605 or in-registration delay length 628, both equal to the same placement value, is set.

One aspect of the invention includes the step of determining, in response to the detecting step, the location of the registration marks relative to a position of an in-registration window and an out-of-registration window. As shown in both cycles 1 and 3, this is accomplished by setting of an in-registration delay length of tubing to be fed past the sealing means in the event that the registration mark is detected by the detecting step within either of the windows. Thereafter, the feeding of the tubing is stopped after the in-registration delay length of tubing has passed the sealing means to allow sealing of the tubing as indicated at points 610 and 630. The in-registration window has a position which is a function of the location of a seal of the tubing in response to a previous stopping step. For example, as shown in cycle 1, in-registration window 603 begins t seconds (or counts) after point 601.

In general, the out of registration window has a position which is a function of the location of the in-registration window. For example, as shown with respect to cycles 2 and 3 of FIG. 6A, out of registration window 624 immediately follows the out of registration stop when no eye-spots are detected within in-registration window 612.

In one embodiment of the invention, tubing is fed past the sealing means as registration marks are detected. The location of the registration marks relative to a position of a window, such as in-registration window 603 or out of registration window 624, is determined in response to the detecting step. In response to this determination step, an in-registration delay length such as length 605 is set defining a length of tubing to be fed past the sealing means in the event that the detecting step detects a registration mark within the window. As indicated by point 610, the feeding of the tubing is stopped after the in-registration delay length 605 of tubing has passed the sealing means to allow sealing of the tubing at that point. An out of registration delay length such as length 622 is set to be fed past the sealing means in the event that the detecting step fails to detect a registration mark within the window. As indicated by point 620, in response to the determining step, the feeding of the tubing is stopped in the event that the determining step fails to detect a registration mark within in-registration window 612 to allow sealing of the tubing at that point. Thereafter, the out of registration delay length is fed past the sealing means after sealing of the tubing at point 620. The sealing operation is usually required to keep the product contained in the tube if a pull is made which is longer than the rear sealing surface.

Figure 6B:
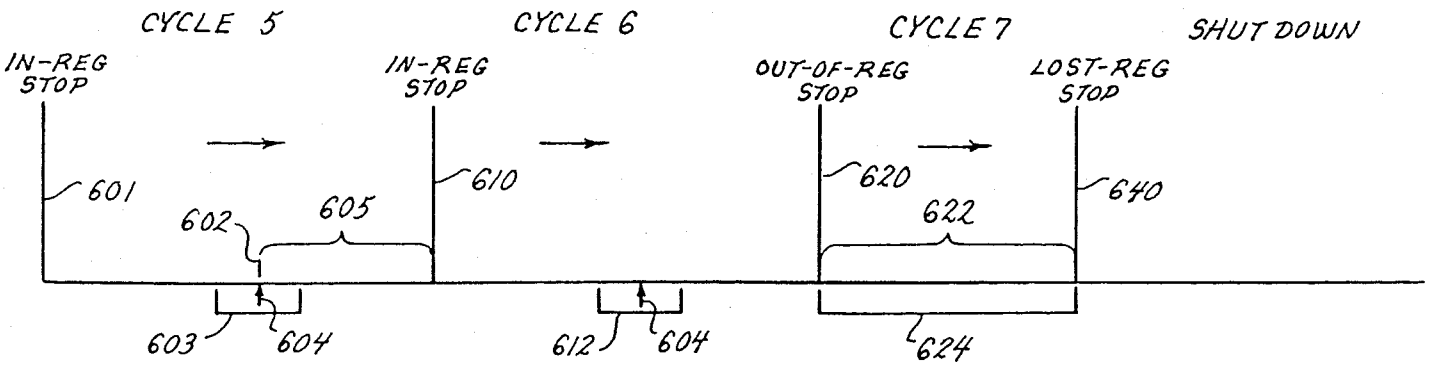
FIG. 6B is a time line illustration of the events resulting from the use of the registration system including the out of registration restoration procedures of the invention wherein registration is lost.

FIG. 6B is a time line illustration similar to FIG. 6A of the events resulting from the use of the registration system according to the invention. The time line of FIG. 6B illustrates a failed attempt to restore an out of registration condition in which registration marks are not detected and results in the system being shut down. In particular, cycles 5 and 6 of FIG. 6B correspond to cycles 1 and 2, respectively, of FIG. 6A. Immediately after point 620, out of registration delay length 622 is set because no registration marks were detected within in-registration window 612. However, contrary to the cycle 3 situation, no eyespots are detected within the period of time that out of registration delay length 622 passes the sealing means. In other words, there are no registration marks detected within out of registration window 624. Therefore, the total loss of registration is confirmed and the procedure is discontinued by stopping and sealing at point 640. In other words, this embodiment of the invention includes the step of stopping the feeding of the tubing in the event that the detecting step fails to detect a registration mark during the period that the out of registration delay length 622 is fed past the sealing means.

In the embodiment illustrated in FIG. 6B, the out of registration window 624 corresponds to the out of registration delay length 622. Therefore, this embodiment of the invention also includes the step of stopping, in response to the determining step, the feeding of the tubing in the event that the detecting step fails to detect a registration mark within the out of registration window 624 to conserve film.

Referring to FIGS. 6A and 6B, should the film length change during a particular run due to a change in bag length, a shift in the eyespot position on the film, print variations, stretching of the film due to a change in tension or other varying conditions, there will be a shift in the eyespot in the window and there is a possibility of having the eyespot detected outside the window resulting in an out of registration condition. In order to compensate for film length variations, the invention adjusts the magnitude of the in-registration delay length in response to a comparison of the location of the eyespot and adjusts the target point location, which is at the center of the in-registration window, by adjusting the magnitude of the length of the initial pull. This aspect of the invention is illustrated in the time line of FIG. 6C.

In general, variable length compensation operates in the following manner. When an eyespot is detected within a window which begins after a feeding of the tubing during the initial pull for a time t, the difference between the target point and the actual point of the eyespot is noted. In regard to cycles 8–11, each point 650 indicates a stop, fill, seal and cut location. After feeding the tubing for a period of time t, in-registration window 652 begins so that the system begins detecting registration marks. Eyespot 654 appears before the target point 656. In-registration delay length 658 is counted (or timed) from the location of the eyespot 654.

Figure 6C:
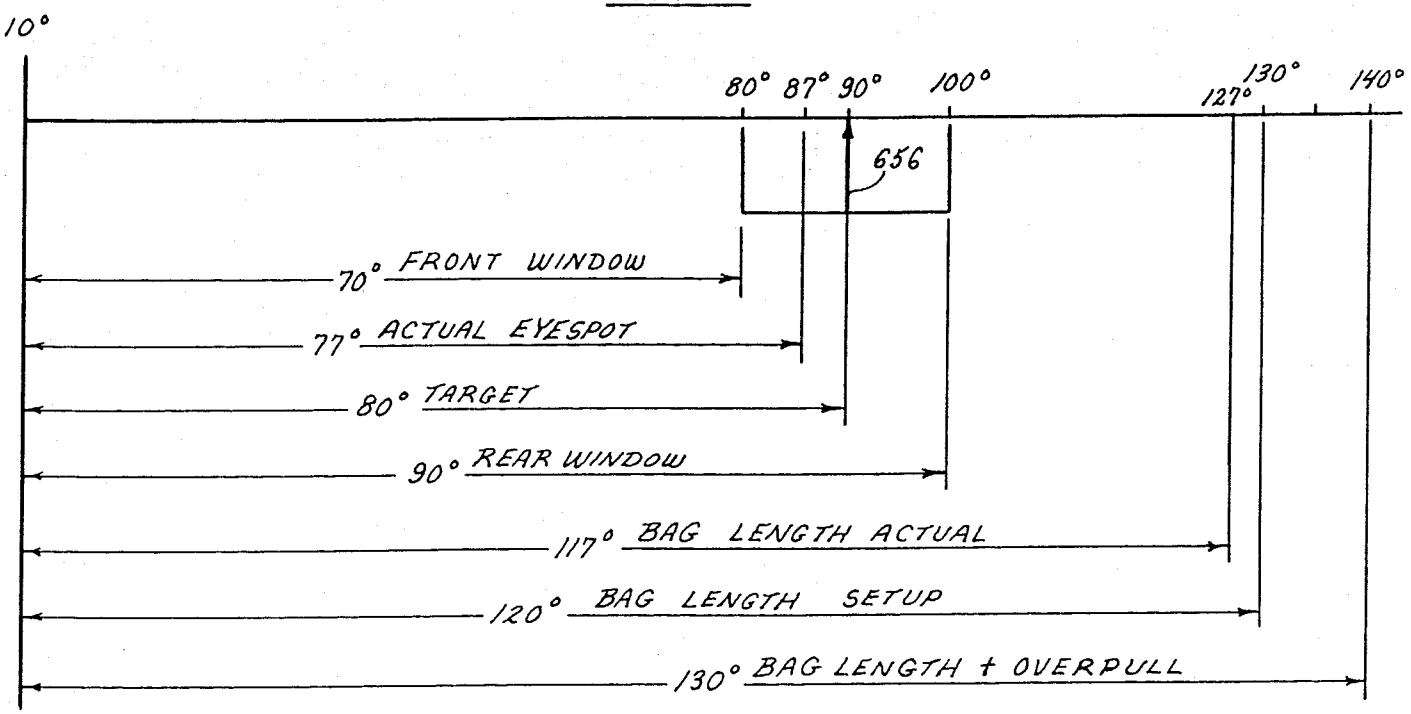
FIG. 6C is a time line illustration of a setup of a bag with certain predefined parameters.

By way of example, assume that the initial pull length during the time t, from the start of the feeding of the tubing until the beginning of in-registration window 652, equals 70°. In addition, assume that the window width equals 20°, that the target point is in the center of the window at 80°, and that the in-registration delay length equals 40°. Assuming a 10° overpull, the actual timing in degrees is shown as 6C. FIG. 6C depicts a setup of a bag with the following parameters:

Length = 120°
Start of pull to eyespot = 80°
Eyespot to end of pull = 40°
Pull start = 10°
In-registration delay length = 40°
Overpull = 10°
Window = 20°

Figure 6D:
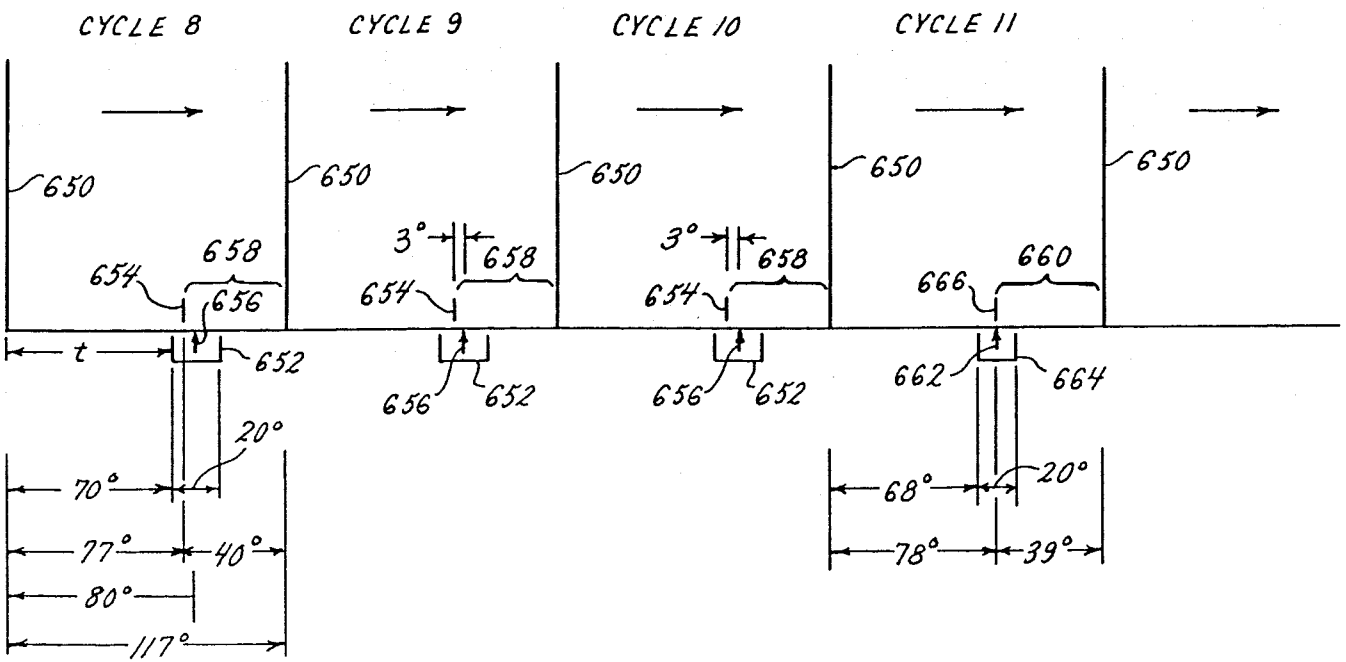
FIG. 6D is a time line illustration of the events resulting from the use of the registration system including the variable length compensation procedures of the invention wherein the delay length is adjusted to compensate for variations in the location of the registration marks on the film.

In actual degrees of cycle, the numbers are shown in FIG. 6C. In this case, the normal stop point would be 130° or target (90) + in-registration delay (40) = 130. If we assume the bag to be 3° shorter than setup, we would detect an eyespot at 87° and stop at 87 + 40 = 127° for a total pull of 127 − 10 = 117° or three° shorter than the setup of 120°. Successive cycles are illustrated in FIG. 6D.

Figure 6E:
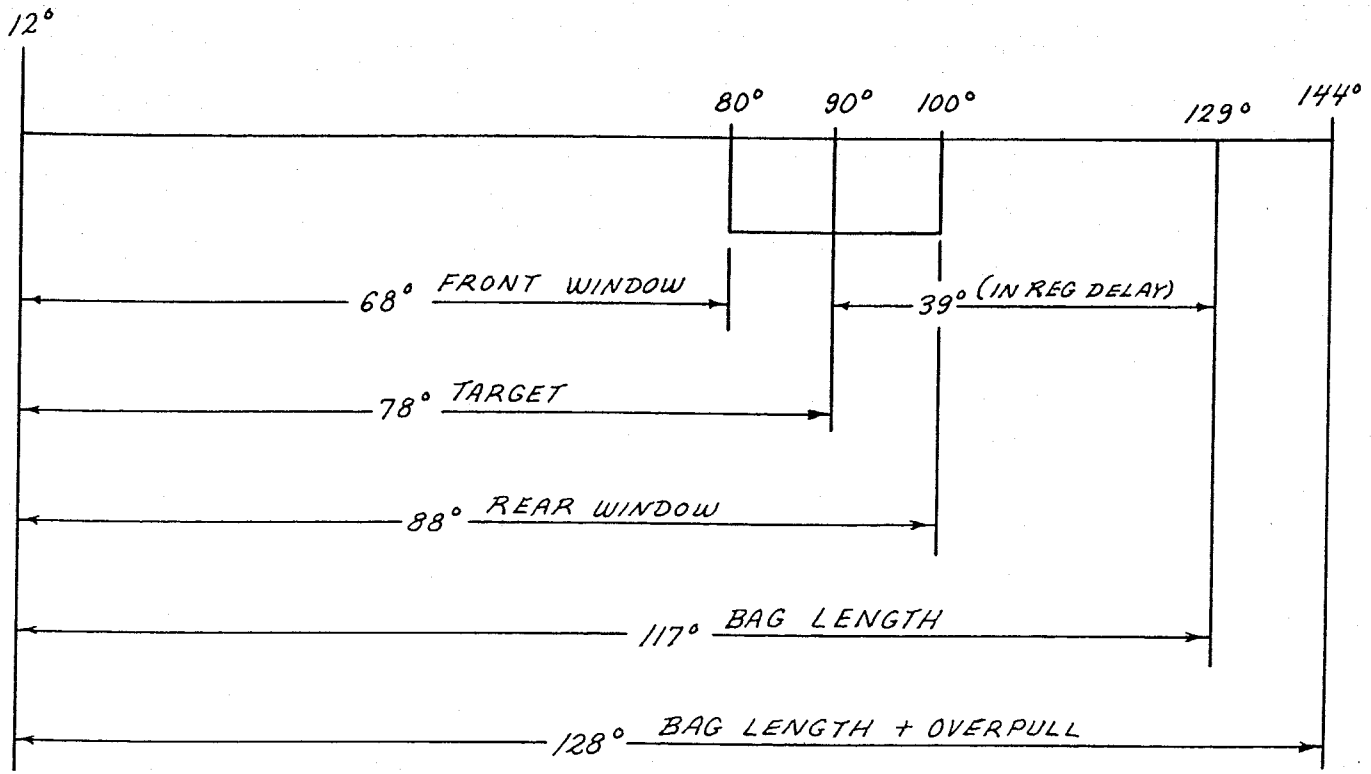
FIG. 6E is a time line illustration of the setup in FIG. 6C after adjustment of parameters for a 3° correction.

As shown with regard to cycle 8, eyespot 654 is detected at the 77° point which is 3° before the target point 656 which is 80° from point 650A. (This 3° error is an exaggerated amount used for illustration.) This condition is indicative of a bag which is 3° shorter than the setup parameters. Cycles 9 and 10 are the same as cycle 8 and indicate that the eyespot 654 precedes the target point 656 by 3°. After each cycle, the difference between the target point and the count point is noted and added to a cumulative error sum. After accertain number of cycles or iterations, the cumulative sum is averaged and if the average yields a correction value which is greater than a preset minimum, such as 1°, the initial pull length t and in-registration delay lengths are proportionally incremented or decremented by an amount equal to the correction value multiplied by the ratio of the respective lengths to the total pull length. In the illustration of FIG. 6C, assume that the bag length has decreased, that error correction occurs every 10 cycles and that the cumulative sum of errors after cycle 10 equals −30°. The correction value equals the sum divided by the number of cycles occurring during the summation or −30° divided by 10 cycles or for a correction value of −3° per cycle. Accordingly, in cycle 11, the initial pull length is proportionally decreased 2° = 3° × (80°/120°) and the in-registration delay length 660 is proportionally decreased 1° = 3° × (40°/120°). After compensation for the variable length as shown in cycle 11, the initial feeding of the tubing is carried out for 68° followed by a 20° window wherein the adjusted location of the target point 662 is 78° from the start point 650 and the in-registration delay length 660 is 39°. As a result, eyespot 666 appears directly at the same location as target point 662 and the system is in registration after variable length compensation according to the invention. Therefore, the system of the invention compensates for varying lengths between eyespots by adjusting the magnitude of the in-registration delay length so that it equals a preset amount (such as the in-registration delay length of a previous cycle) adjusted by the difference between the location of the detected registration mark and a target location within the in-registration window multiplied by a ratio of the preset amount to the magnitude of the total feed length before sealing and after the previous sealing at the end of the previous cycle. The system of also compensates for varying lengths between eyespots by adjusting the magnitude of the initial pull (feed) length during time t (i.e., before the delay length and after the previous sealing) equals a predefined amount (such as the initial pull [feed] length of a previous cycle) adjusted by the difference between the location of the detected registration mark and a target location within the in-registration window multiplied by a ratio of the predefined amount to the magnitude of the total feed length before sealing and after the previous sealing at the end of the previous cycle. The absolute results are shown as FIG. 6E.

In particular, by apportioning the error correction value between the initial pull length t and the in-registration delay length, the position of the graphics with respect to each start point 650 remains constant. In this way, the graphics are centered along the length of the bag. Alternatively, if the graphics location is not a consideration, the error correction value may be used to adjust only the initial pull length or the in-registration delay length or a predefined ratio and be used to apportion the error correction value between the initial pull length and the in-registration delay length.

The correction values applied to the initial pull length and the in-registration delay length may not equal the total correction value or be in proportion to the pull length and delay length, respectively. In the above example, the error correction value was apportioned proportionally so that the total pull length for cycle 11 (117°) equals the total pull length for cycle 10 (120°) as adjusted by the error correction value (−3°) or 117° = 120° − 3°. In actual operation, this may not always occur due to rounding errors. Generally, the resolution bandwidth (accuracy) of a photoeye equals ±0.5° so that adjustments for less than 0.5° are not made.

Figure 7A:
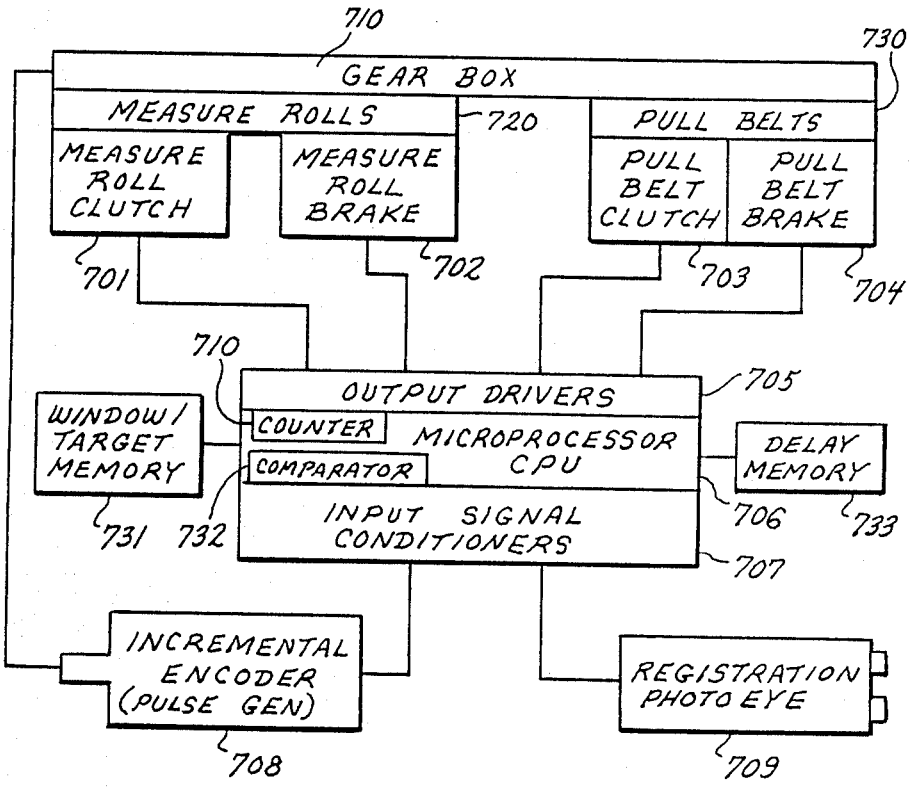
FIG. 7A, is a schematic illustration in block diagram form showing a form, fill and seal registration system apparatus of the invention.

FIG. 7A illustrates one embodiment of a form, fill and seal registration system apparatus including variable length compensation and out of registration restoration according to the invention. The apparatus includes prime movers for pulling the film including measure rolls controlled by measure roll clutch 701 and measure roll brake 702 and pull belts controlled by pull belt clutch 703 and pull belt brake 704. The control system providing logic to control the pull includes output drivers 705, microprocessor central processing unit (CPU) 706 and input signal conditioners 707. The position sensor for metering of the film comprises incremental encoder 708 or similar device. The position sensor for detecting registration marks on the film comprises registration photoeye 709.

The prime movers, i.e., the measure rolls and the pull belts, are controlled by clutches 701 and 703 to drive the film pull and by brakes 702 and 704 to accurately stop the pull. The clutch and brake functions are complimentary of each other, i.e., when the brakes are on the clutches are off and vice versa. The measure roll and the pull belts are usually set to run for the same number of degrees in the cycle, although this is not necessarily a requirement. The clutches and brakes are not essential to the operation of the invention and any device for controlling the pull of the film such as stepping motors or servo motors may be used.

The pull is set to operate for a fixed number of degrees to obtain a predetermined length of bag. As an example, if it is desired to pull a ten inch long bag, and 1° represents ⅛ inch of pull, the pull would have to be 80° long to obtain a ten inch long bag. Bag length can be specified in degrees, inches, millimeters or any other length unit so long as the conversion factor is known. In the case of a plain film pull, the pull length is set directly, as discussed above with regard to FIG. 1. In the case of a pull of a film having registration marks, the film pull length is set to be from ¼" to ½" longer than the repeat distance between the eyespots. This is done to allow the system to pull longer if required to keep the bag being pulled in registration.

The actual pull length is determined by counting the pulses from incremental encoder 708 or other pulse generator attached directly to gear box 709 or measure rolls. Encoder 708 generates a pulse train which is representative of the speed of gear box 709 as well as the speed of the measure rolls and pull belts, since these elements are driven directly from gear box 709. As a result, eighty counts of encoder 708 would represent 10" of pull in the illustrated example. The ratio of counts to pull length is dependent upon the encoder resolution and gear box ratio, belt and gear ratios from the gear box to the measure rolls and to the pull belts, and the diameter of the measure rolls and the pull belt sheaves. The length determining device in a system such as illustrated in FIG. 7A is the measure rolls. Generally, the pull belts function to assist the film over the forming shoulder and are not designed to meter the film. The position of the film is determined by registration photoeye 709.

The films which are run on the system typically have a registration mark on a clear eye track. Although this is the typical situation, it is contemplated that registration photoeye 709 may also detect bag headers or other distinctive printing on the film in place of the eyespot on the clear background. As the film is pulled by the measure rolls (and pull belts), the registration eye 709 looks down on the film along the eye track to detect eyespots or other registration marks. The eye track is determined by the physical location of the film and the relative position of registration of photoeye 709. The eye can be moved to line up with the eyespots and is generally centered in the spots to provide a maximum amount of variation in either direction before the eyespot is not detected by the eye. The eyespot is generally scanned for a leading edge to eliminate any inaccuracy due to registration mark width.

Reference character 707 generally refers to input signal conditioners which optically isolate and filter the input signals from incremental encoder 708 and registration photo eye 709 so that these signals can be logically processed by CPU 706. Similarly, output drivers 705 convert logic signals from CPU 706 into high power signals to drive the clutches and brakes (or any other prime mover). Output drivers 705 provide optical isolation between the logic voltages of CPU 706 and the clutches, brakes, and other prime movers.

The logic block is shown as microprocessor CPU 706. Although most modern systems utilize microprocessor control, it is not necessary that the system according to the invention include a microprocessor control. For example, a logic block may be TTL, CMOS, HCTL, or other logic families and gates, if desired, so long as the logic is assembled to achieve the results desired as described herein.

FIG. 7A illustrates an apparatus according to the invention for sealing packages within a web of flexible packaging material having a series of registration marks is formed into tubing and fed past sealing means for sealing the tubing to form packages. Measure rolls 720 and pull belts 730 constitute means for feeding the tubing past the sealing means. Registration photo eye 709 constitutes sensor means for detecting the registration marks. CPU 706 constitutes means, responsive to the registration photo eye 709, for comparing the location of registration marks relative to a window as defined by information stored in window/target memory 731. CPU 706 may include a comparator 732 as means for comparing. Counter 710 constitutes delay means, responsive to the comparing means, for setting a delay length of tubing to be fed past the sealing means in response to the relative location of the registration marks and the window. CPU 706 also constitutes means for stopping the feeding of the tubing after the delay length of tubing has passed the sealing means. As indicated above, the delay length has a magnitude which is a function of the relative location of the registration marks on the window as determined by comparator 732.

CPU 706 also constitutes determining means, responsive to the sensor means, for determining the location of the registration marks relative to a position of an in-registration window and an out of registration window. Delay memory 733 constitutes delay means, responsive to the determining means, for setting an in-registration delay length of tubing to be fed past the sealing means in response to detection b the sensor means of a registration mark within either of the windows. CPU 706 in conjunction with measure roll brake 702 and pull belt brake 704 constitutes first means for stopping the feeding of the tubing after the in-registration delay length of tubing has passed the sealing means to allow sealing of the tubing at that point. For example, CPU 706, brake 702 and brake 704 function as in-registration stop means at points 601, 610, 630 and 650 of FIGS. 6A, 6B and 6C. CPU 706, brake 702 and brake 704 also constitute loss registration means for stopping the feeding of the tubing in response to failure of the sensing means to detect a registration mark within the out of registration window, as shown at point 640 of FIG. 6B. CPU 706, brake 702 and brake 704 also constitute out of registration stop means, responsive to the determining means, for stopping the feeding of the tubing in response to failure of the determining means to detect a registration mark within the in-registration window to allow sealing of the tubing at that point, as shown at point 620 of FIG. 6A. Delay memory 733 constitutes in-registration delay means as well as out of registration delay means.

Figure 7B:
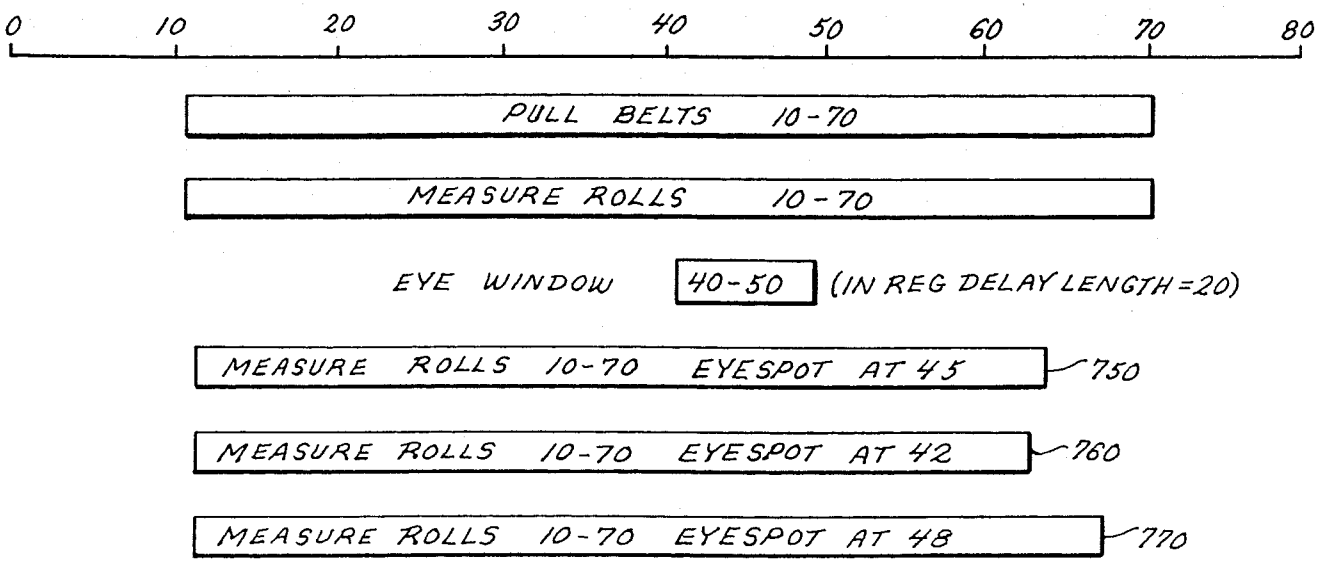
FIG. 7B is a time line bar graph illustrating the events resulting from the use of the registration system of the invention.

FIG. 7B illustrates the effects of eyespot variation within the window as a function of the stopping point of the measure rolls. In FIG. 7B, it is assumed that the measure rolls and pull belts start point is a constant. The pull is set from 10° to 70° for a total pull of 60°. If the placement or in-registration delay length value is set for 20°, the in-registration window is positioned from 40° to 50° as shown. Reference character 750 illustrates the ideal situation when the eyespot is detected at the 45° mark within the window. In this case, the placement of value of 20 is placed into the decrementing counter 710 of CPU 706 at 45°. When the count reaches zero (65°), the measure rolls and pull belts are stopped. Similarly, if the eyespot is detected at 42° as indicated by reference character 760, the stopping point is 62°, 3° earlier than the ideal, indicating that the bag being pulled is shorter than the setup.

In the prior art, at this point the starting point would be incremented to 11° in order to pull less film to bring the eyespot closer to the desired 45° target point on the next cycle. In this case, too much film has been pulled with the 20° placement pull and the next pull must be made shorter. In the prior art, all compensation was done from the start of the pull to the eyespot and the placement (pull from the eyespot to the cut-off) was fixed. Because of this, the graphics on the film would not be located in the same relative location as the bag length changes and operator intervention would be required to add or subtract the in-registration delay length degrees as the eyespot repeat lengthens due primarily to the conversion and winding process.

A bag length which is too long is illustrated by reference character 770 when the eyespot is detected at 48°. In the prior art, the start value would be decremented from 10° to 9° in order to pull longer in order to get the eyespot back in the center of the window. Unfortunately, these changes must be manually adjusted by operator intervention.

According to the invention, the in-registration delay length number as well as the measure roll value are adjusted to compensate for variable length. To illustrate, assume that the bag is 2° longer than the target length. Rather than correcting every cycle manually as suggested by the prior art, the invention runs a preset number of cycles, such as 100 bags, and then effects correction. During the 100 bag run, CPU 706 keeps track of the deviations from the target for each of the 100 cycles. Variation in bag lengths will appear directly as the deviation from the target point in the window. For example, after averaging deviations for 100 bags, it may be determined that the variation is 2° per cycle. This variation would result in a correction in the form of a 1° decrement in the initial pull value from 10° to 9°. As a result, 36° rather than 35° would be pulled to the center of the window or an increase of 1° would be effected. The in-registration delay correction would be 0.5° so that the in-registration delay length shifts from 20° to 20.5°. In this example, the total pull would increase a total of 1.5° of the 2° detected due to roundoff errors and the 0.5° resolution of the encoder. One important aspect of the invention is that the error correction between the two pull segments of the bag (i.e., the pull and the placement) has been distributed between the segments. The error correction for each segment equals the error times the ratio of the segment to the total pull (i.e., total of the two segments). Therefore, the invention avoids the need for the operator to manually adjust the placement for variation in the bag length caused by variations such as variations in the conversion and printing processes of the film.

Figure 8:
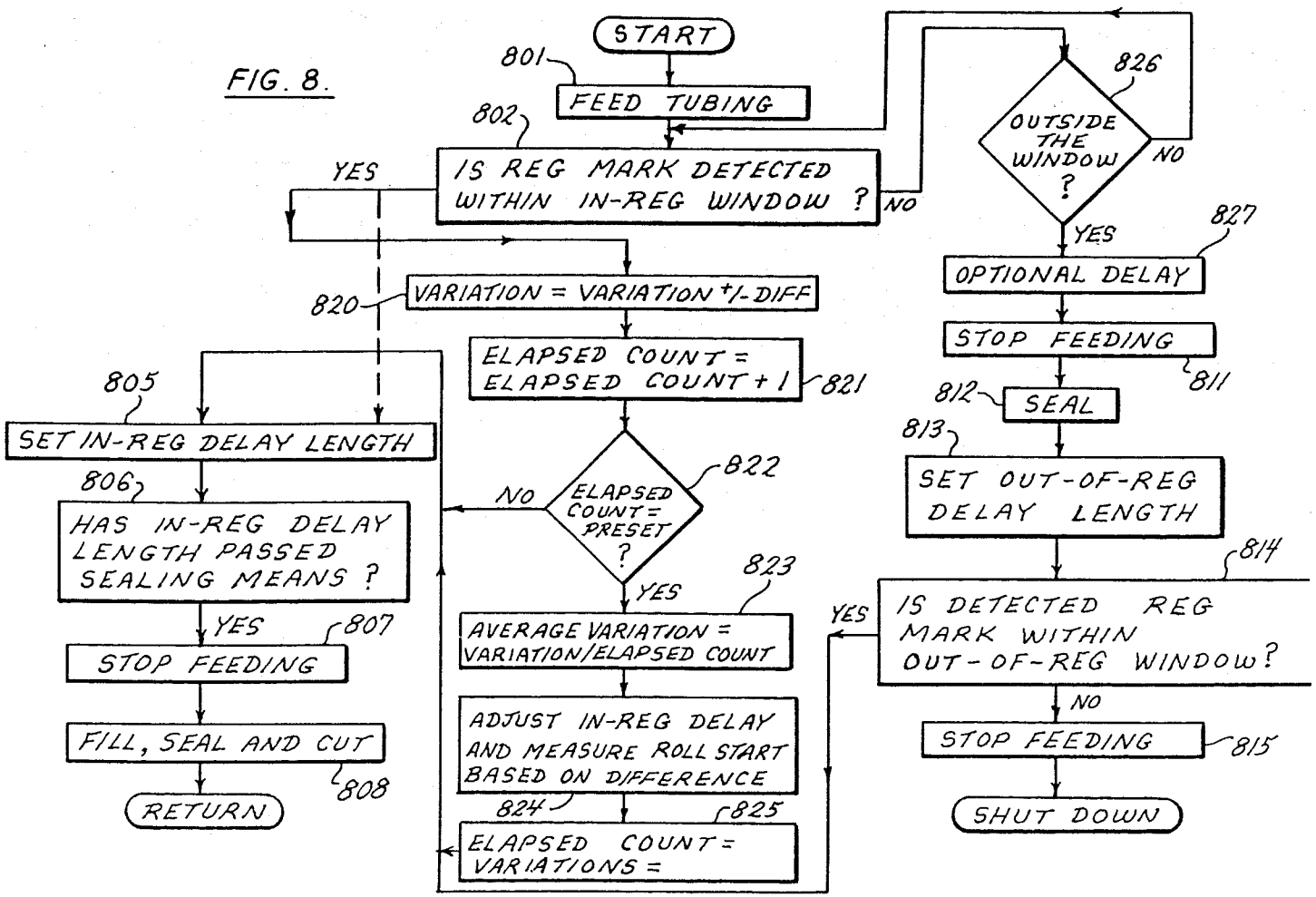
FIG. 8 is a flow chart in block diagram form illustrating the operation of a form, fill and seal registration system apparatus and method according to the invention for registered film having registration marks.

FIG. 8 summarizes the process according to the invention. CPU 706 actuates clutches 701 and 703 to begin feeding of the tubing at step 801. Thereafter, registration photoeye 709 begins detecting registration marks and, in particular, looks for registration marks within the in-registration window defined by window/-target memory 731 in accordance with step 802. If a registration mark is detected during the in-registration window by registration photoeye 709, step 803 is performed. The difference between the target point and the location of the detected registration mark is compared by comparator 732 of CPU 706. This difference is added to or subtracted from the accumulated variation at 820. The elapsed count is incremented by 1 and if it is not equal to the preset count (typically 1–100), the in-registration delay is set at 805. If the elapsed count equals the preset value, the average variation is calculated in step 823. Based on this FIG. 8, the in-registration delay as well as the measure roll start point are adjusted by the appropriate ratios at 824. Following this, the elapsed count and variation are both set equal to aero at 825 and the process moves to 805. Step 805 is performed to set the in-registration delay length. This step is accomplished by CPU 706 by referring to delay memory 733 and actuation of counter 710. CPU 706 decrements counter 710 in accordance with incremental encoder 708 until the in-registration delay length has passed the sealing means in accordance with step 806. Thereafter, the feeding of the tubing is stopped by step 807, the tubing is filled, sealed and cut by step 808 and the process begins again.

In the event that no registration mark is detected within the in-registration window by steps 802 and 826, feeding of the tubing is stopped by step 811 after an optional delay by 827 and the tubing is sealed by step 812. CPU 706 in accordance with delay memory 733 then sets the out of registration delay length as required by step 813. If a registration mark is detected during the out of registration delay length (which corresponds to the out of registration window) by step 814, the process proceeds to step 805; otherwise the feeding of the tubing is stopped by step 815 and the system is shut down until operator intervention can determine the reason for the failure to detect registration marks.

Figure 9C:
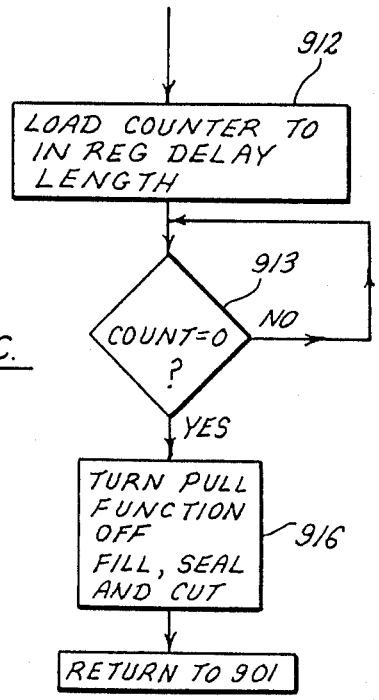
Figure 9B:
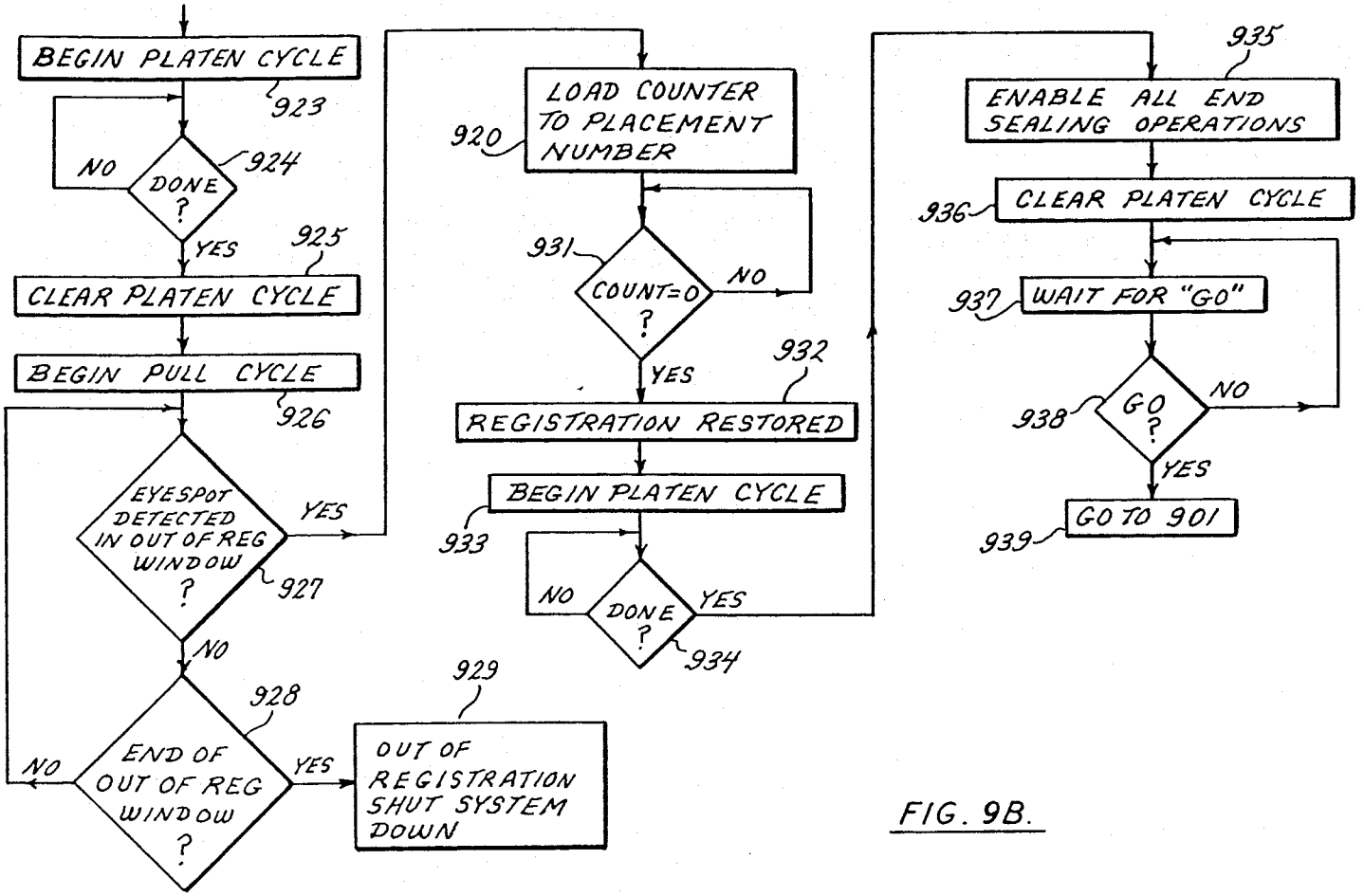

FIGS. 9A, 9B and 9C illustrate one embodiment of the adaptive control according to the invention to compensate for bag length variation as well as automatically restore registration in the event an eyespot is missed during the film pull. The cycle begins by initiating the proper outputs to cause the measure rolls and pull belts to begin the film pull at step 901. At step 902, the photoeye looks for an eyespot during the window. If an eyespot is seen but is not during the window, step 903 actuates step 904 to notify the operator that an eyespot has been detected out of the window and that multiple eyespots have been detected which is usually an indication that the photoeye is not adjusted correctly and/or some preventative maintenance is required.

When the eyespot is seen within the window, at step 905 the CPU calculates the difference between the target point and the actual count point at which the eyespot is detected and this difference is added to the cumulative sum by step 906. The iteration is incremented by the CPU at step 907. The in-registration flag is set at step 907A. If the iteration equals the preset number, say 100, the sum will be averaged by the CPU at step 909.

If the CPU at step 910 determines that the error is greater than 1, the target and placement values are incremented or decremented by the average error multiplied by their respective ratios to the total pull by step 911. If step 910 determines that the error is less than 1, the process proceeds directly without error correction to step 912 because the error is considered too small to correct.

Incrementing or decrementing the in-registration delay length and target values as a function of the ratio of their length to total length allows the bag to grow or shrink while allowing the ratio of eyespot position to remain in a constant ratio and, at the same time, eliminates the need for any operator intervention. As a result, the graphics will remain in registration with the bag ends and will not move relative to the cut-off points as a function of bag length.

If the iteration determined by step 908 is not equal to the preset, or if the error determined by step 910 is not greater than 1, or if the adjustment has been made by the CPU at step 911, the process proceeds to step 912 to load the in-registration delay length into the counter and begin decrementing. When the CPU at step 913 determines that the count in the counter has been decremented to zero, the CPU then initiates step 916 to discontinue the pull so that the tubing may be filled, sealed and cut and the cycle continued.

Going back to the top of FIG. 9A, after step 902, if the eyespot is not detected by the photoeye prior to the end of window by step 903*a*, the result is that there is an out of registration condition. In order to minimize operator intervention, the following process according to the invention is carried out. The CPU initiates step 917 to set the out of registration flag and step 918 to determine whether the eye track is clear. If the eye track is unclear, this is reported to the operator by step 919 and the system is shut down at step 920. If there is a clear eye track as determined by registration photoeye 709, all end sealing functions are inhibited by step 921, the pull is stopped by step 922 and the platen cycle is started by step 923. At this point, a back seal is made as though this were a double pull in order to retain integrity on the back seal and prevent product from spilling on the floor. The remainder of the process is equivalent to a film set up condition looking for a lost eyespot. Step 924 determines that the platen cycle has been completed, step 925 clears the platen cycle and the pull cycle is begun again by step 926. At this point, the out of registration window or out-of-registration delay length is set. If step 927 does not detect an eyespot before the end of the out of registration window as determined by step 928, the system is shut down by step 929. If an eyespot is detected by step 927, the process proceeds to step 930 to load the placement value in the counter and decrement it until the counter reaches zero at step 931. When count equals zero, the registration has been restored as indicated at step 932. The platen is again cycled at 933 until its cycle is completed as determined by step 934. End sealing operation are restored by 935 and the platen output is turned off at 936. The cycle remains at blocks 937 and 938 until a "go" signal is received from the feed system. When a "go" is received, the cycle is repeated b going to step 901.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In an apparatus for sealing packages wherein a web of flexible packaging material having a series of registration marks is formed into tubing and fed past sealing means for sealing the tubing to form packages, an improved control system comprising:

means for feeding the tubing past the sealing means;

sensor means for detecting the registration marks;

means, responsive to the sensor means, for comparing the location of registration marks relative to a window;

delay means, responsive to the comparing means, for setting a delay length of tubing to be fed past the sealing means in response to the relative location of the registration marks and the window;

means for stopping the feeding of the tubing after said delay length of tubing has passed the sealing means.

2. The system of claim 1 wherein said delay means includes means for setting an in registration delay length of tubing to be fed past the sealing means in response to detection by said sensor means of a registration mark within the window and means for setting an out of registration delay length to be fed past the sealing means in response to failure of said sensor means to detect a registration mark within the window; and wherein said stopping means includes means for stopping the feeding of the tubing after said in registration delay length of tubing has passed the sealing means to allow sealing of said tubing at that point and means for stopping the feeding of the tubing in response to failure by said sensor means to detect a registration mark during the period that said out of registration delay length is fed past the sealing means.

3. The system of claim 1 wherein said means for stopping includes means for stopping the feeding of the tubing after said delay length of tubing has passed the sealing means to allow sealing of said tubing at that point in response to detection of a registration mark by said sensor means within the window.

4. The system of claim 1 wherein said means for stopping includes means for stopping the feeding of said tubing to allow sealing of said tubing in response to failure of said sensor means to detect a registration mark within the window.

5. The system of claim 1 wherein the delay length has a magnitude which is a function of the relative location.

6. The system of claim 5 wherein the magnitude of the delay length equals a preset amount adjusted by the difference between the location of the detected registration mark and a target location within the window multiplied by a ratio of the preset amount to the magnitude of the total feed length before sealing and after the previous sealing.

7. The system of claim 6 wherein the preset amount equals the delay length of a previous cycle of the system.

8. The system of claim 6 wherein the magnitude of the initial feed length before the delay length and after the previous sealing equals a predefined amount adjusted by the difference between the location of the detected registration mark and a target location within the window multiplied by a ratio of the predefined amount to the magnitude of the total feed length.

9. The system of claim 8 wherein the predefined amount equals the initial feed length of a previous cycle of the system.

10. The system of clair 1 wherein said means for comparing comprises a central processing unit and said delay means comprises a counter loaded by the central processing unit and decremented as a function of feeding of the tubing.

11. In an apparatus for sealing packages wherein a web of flexible packaging material having a series of registration marks is formed into tubing and fed past sealing means for sealing the tubing to form packages, an improved control system comprising:

means for feeding the tubing past the sealing means;

sensor means for detecting the registration marks;

determining means, responsive to the sensor means, for determining the location of registration marks relative to a position of an in registration window and an out of registration window;

delay means, responsive to the determining means, for setting an in registration delay length of tubing to be fed past the sealing means in response to detection by said sensor means of a registration mark within either of said windows;

in-registration stop means for stopping the feeding of the tubing after said in registration delay length of tubing has passed the sealing means to allow sealing of said tubing at that point, said in registration window having a position which is a function of the location of a seal of said tubing in response to said first means and said out of registration window having a position which is a function of the location of said first window;

out of registration stop means for stopping the feeding of the tubing in response to failure of said sensing means to detect a registration mark within the out of registration window.

12. The system of claim 11 further comprising out of registration stop means, responsive to the determining means, for stopping the feeding of the tubing in response to failure of said determining means to detect a registration mark within the in registration window to allow sealing of said tubing at that point, said out of registration window having a position which is a function of the location of a seal of said tubing in response to said out of registration means.

13. The system of claim 11 wherein said delay length has a magnitude which is a function of the relative location of the registration marks and the windows.

14. The system of claim 11 wherein said means for determining comprises a central processing unit and said delay means comprises a counter loaded by the central processing unit and decremented as a function of feeding of the tubing.

15. In an apparatus for sealing packages wherein a web of flexible packaging material having a series of registration marks is formed into tubing and fed past sealing means for sealing the tubing to form packages, an improved control system comprising:

means for feeding the tubing past the sealing means;

sensor means for detecting the registration marks;

determining means, responsive to the sensor means, for determining the location of registration marks relative to a position of a window;

in registration delay means, responsive to the determining means, for setting an in registration delay length of tubing to be fed past the sealing means in response to detection by said sensor means of a registration mark within the window;

in registration stop means for stopping the feeding of the tubing after said in registration delay length of tubing has passed the sealing means to allow sealing of said tubing at that point;

out of registration delay means, responsive to the determining means, for setting an out of registration delay length to be fed past the sealing means in response to failure of said sensor means to detect a registration mark within the window; and out of registration stop means, responsive to the determining means, for stopping the feeding of the tubing in response to failure of said sensing means to detect a registration mark during the period that said out of registration delay length is fed past the sealing means.

16. The system of claim 15 further comprising out of registration stop means, responsive to the determining means, for stopping the feeding of the tubing in response to failure of said determining means to detect a registration mark within the window to allow sealing of said tubing at that point, said out of registration delay length being fed past said sealing means after sealing of said tubing in response to said out of registration delay means.

17. The system of claim 15 wherein said in registration delay length has a magnitude which is a function of the location of the detected registration marks relative to the window.

18. The system of claim 15 wherein the magnitude of the in registration delay length equals a preset amount adjusted by the difference between the location of the detected registration mark and a target location within the window multiplied by a ratio of the preset amount to the magnitude of the total feed length before sealing and after the previous sealing.

19. The system of claim 18 wherein the preset amount equals the in registration delay length of a previous cycle of the system.

20. The system of claim 18 wherein the magnitude of the initial feed length before the in registration delay length and after the previous sealing equals a predefined amount adjusted by the difference between the location of the detected registration mark and a target location within the window multiplied by a ratio of the predefined amount to the magnitude of the total feed length.

21. The system of claim 20 wherein the predefined amount equals the initial feed length of a previous cycle of the system.

22. The system of claim 15 wherein said means for determining comprises a central processing unit and said in registration delay means comprises a counter loaded by the central processing unit and decremented as a function of feeding of the tubing.

23. In an apparatus for sealing packages wherein a web of flexible packaging material having a series of registration marks is formed into tubing and fed past sealing means for sealing the tubing to form packages, an improved control system comprising:

means for feeding the tubing past the sealing means;

sensor means for detecting the registration marks;

determining means for determining the location of a registration mark detected by said sensor means relative to a window;

delay means, responsive to said determining means, for setting a delay length of tubing to be fed past the sealing means in response to detection of a registration mark, said delay length having a magnitude which is a function of the relative location of the detected registration mark and the window; and means for stopping the feeding of the tubing after said delay length of tubing has passed the sealing means to allow sealing of said tubing at that point.

24. The system of claim 23 wherein the magnitude of the delay length equals a preset amount adjusted by the difference between the location of the detected registration mark and a target location within the window multiplied by a ratio of the preset amount to the magnitude of the total feed length before sealing and after the previous sealing.

25. The system of claim 24 wherein the preset amount equals the delay length of a previous cycle of the system.

26. The system of claim 24 wherein the magnitude of the initial feed length before the delay length and after the previous sealing equals a predefined amount adjusted by the difference between the location of the detected registration mark and a target location within the window multiplied by a ratio of the predefined amount to the magnitude of the total feed length.

27. The system of claim 26 wherein the predefined amount equals the initial feed length of a previous cycle of the system.

28. The system of claim 26 wherein the difference is averaged over a predetermined number of cycles.

29. The system of claim 28 wherein the predetermined number of cycles equals 100.

30. The system of claim 23 wherein said means for determining comprises a central processing unit and said delay means comprises a counter loaded by the central processing unit and decremented as a function of feeding of the tubing.

31. In an apparatus for sealing packages wherein a web of flexible packaging material having a series of registration marks is formed into tubing and fed past sealing means for sealing the tubing to form packages, an improved control system comprising:

means for feeding the tubing past the sealing means;

sensor means for detecting the registration marks;

determining means for determining a difference between a target location and the detected location of a registration mark detected by said sensor means;

delay means, responsive to the determining means, for setting a delay length of tubing to be fed past the sealing means in response to detection of a registration mark, said delay length having a magnitude which is a function of the difference; and means for stopping the feeding of the tubing after said delay length of tubing has passed the sealing means to allow sealing of said tubing at that point.

32. The system of claim 31 wherein the magnitude of the delay length equals a preset amount adjusted by the difference between the location of the detected registration mark and a target location within the window multiplied by a ratio of the preset amount to the magnitude of the total feed length before sealing and after the previous sealing.

33. The system of claim 32 wherein the preset amount equals the delay length of a previous cycle of the system.

34. The system of claim 32 wherein the magnitude of the initial feed length before the delay length and after the previous sealing equals a predefined amount adjusted by the difference between the location of the detected registration mark and a target location within the window multiplied by a ratio of the predefined amount to the magnitude of the total feed length.

35. The system of claim 34 wherein the predefined amount equals the initial feed length of a previous cycle of the system.

36. The system of claim 34 wherein the difference is averaged over a predetermined number of cycles.

37. The system of claim 36 wherein the predetermined number of cycles equals 100.

38. The system of claim 31 wherein said means for determining comprises a central processing unit and said delay means comprises a counter loaded by the central processing unit and decremented as a function of feeding of the tubing.

39. In a method for sealing packages wherein a web of flexible packaging material having a series of registration marks is formed into tubing and fed past sealing means for sealing the tubing to form packages, an improved control method comprising the steps of:

feeding the tubing past the sealing means;

detecting the registration marks;

comparing, in response to the detecting step, the location of registration marks relative to a window;

setting, in response to the comparing step, a delay length of tubing to be fed past the sealing means in response to the relative location of the registration marks and the window;

stopping the feeding of the tubing after said delay length of tubing has passed the sealing means.

40. The method of claim 39 wherein said setting step includes the steps of setting an in registration delay length of tubing to be fed past the sealing means in the event that said detecting step detects a registration mark within the window and setting out of registration delay length to be fed past the sealing means in the event that said detecting step fails to detect a registration mark within the window; and wherein said stopping step includes the steps of stopping the feeding of the tubing after said in registration delay length of tubing has passed the sealing means to allow sealing of said tubing at that point and stopping the feeding of the tubing in the event that said detecting step fails to detect a registration mark during the period that said out of registration delay length is fed past the sealing means.

41. The method of claim 39 wherein said step of stopping includes the step of stopping the feeding of the tubing after said delay length of tubing has passed the sealing means to allow sealing of said tubing at that point in the event that a registration mark is detected by said detecting step within the window.

42. The method of claim 39 wherein said stopping step includes the step of stopping the feeding of said tubing to allow sealing of said tubing in the event that said detecting step fails to detect a registration mark within the window.

43. The method of claim 39 wherein said setting step sets a magnitude of the delay length as a function of the relative location.

44. The method of claim 43 wherein said setting step sets the magnitude of the delay length equal to a preset amount adjusted by the difference between the location of the detected registration mark and a target location within the window multiplied by a ratio of the preset amount to the magnitude of the total feed length before sealing and after the previous sealing.

45. The method of claim 44 wherein said setting step sets the preset amount equal to the delay length of a previous cycle of the system.

46. The method of claim 43 wherein said setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

47. The method of claim 46 wherein said setting step sets the predefined amount equal to the initial feed length of a previous cycle of the system.

48. The method of claim 39 wherein said step of comparing comprises processing by a central processing unit and said step of setting comprises counting by a counter loaded by the central processing unit and decremented as a function of feeding of the tubing.

49. In a method for sealing packages wherein a web of flexible packaging material having a series of registration marks is formed into tubing and fed past sealing means for sealing the tubing to form packages, an improved control method comprising the steps of:

feeding the tubing past the sealing means;

detecting the registration marks;

determining, in response to the detecting step, the location of registration marks relative to a position of an in registration window and an out of registration window;

setting, in response to the determining step, an in registration delay length of tubing to be fed past the sealing means in the event that a registration mark is detected by said detecting step within either of said windows;

stopping the feeding of the tubing after said in registration delay length of tubing has passed the sealing means to allow sealing of said tubing at that point, said in registration window having a position which is a function of the location of a seal of said tubing in response to said first stopping step and said out of registration window having a position which is a function of the location of said in-registration window;

stopping, in response to the determining step, the feeding of the tubing in the event that said detecting step fails to detect a registration mark within the out of registration window.

50. The method of claim 49 further comprising the step of stopping, in response to the determining step, the feeding of the tubing in the event that said determining step fails to detect a registration mark within the in registration window to allow sealing of said tubing at that point, said out of registration window having a position which is a function of the location of a seal of said tubing in response to said third stopping step.

51. The method of claim 49 wherein said setting step sets a magnitude of the delay length as a function of the relative location of the registration marks and the windows.

52. The method of claim 49 wherein said step of determining comprises processing by a central processing unit and said step of setting comprises counting by a counter loaded by the central processing unit and decremented as a function of feeding of the tubing.

53. In a method for sealing packages wherein a web of flexible packaging material having a series of registration marks is formed into tubing and fed past sealing means for sealing the tubing to form packages, an improved control method comprising the steps of:

feeding the tubing past the sealing means;

detecting the registration marks;

determining, in response to the detecting step, the location of registration marks relative to a position of a window;

setting, in response to the determining step, an in registration delay length of tubing to be fed past the sealing means in the event that said detecting step detects a registration mark within the window;

stopping the feeding of the tubing after said in registration delay length of tubing has passed the sealing means to allow sealing of said tubing at that point;

setting, in response to the determining step, an out of registration delay length to be fed past the sealing means in the event that said detecting step fails to detect a registration mark within the window; and stopping, in response to the determining step, the feeding of the tubing in the event that said detecting step fails to detect a registration mark during the period that said out of registration delay length is fed past the sealing means.

54. The method of claim 53 further comprising the step of stopping, in response to said determining step, the feeding of the tubing in the event that said determining step fails to detect a registration mark within the window to allow sealing of said tubing at that point, said out of registration delay length being fed past said sealing means after sealing of said tubing in response to said third stopping step.

55. The method of claim 53 wherein said setting step sets the a magnitude of the in registration delay length as a function of the location of the detected registration marks relative to the window.

56. The method of claim 53 wherein said first setting step sets the magnitude of the in registration delay length equal to a preset amount adjusted by the difference between the location of the detected registration mark and a target location within the window multiplied by a ratio of the preset amount to the magnitude of the total feed length before sealing and after the previous sealing.

57. The method of claim 56 wherein said first setting step sets the preset amount equal to the in registration delay length of a previous cycle of the system.

58. The method of claim 56 wherein said first setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

59. The method of claim 58 wherein said first setting step sets the predefined amount equal to the initial feed length of a previous cycle of the system.

60. The method of claim 53 wherein said step of determining comprises processing by a central processing unit and each of said steps of setting comprises counting by a counter loaded by the central processing unit and decremented as a function of feeding of the tubing.

61. In a method for sealing packages wherein a web of flexible packaging material having a series of registration marks is formed into tubing and fed past sealing means for sealing the tubing to form packages, an improved control method comprising the steps of:

feeding the tubing past the sealing means;

detecting the registration marks;

determining the location of a registration mark detected by said detecting step relative to a window;

setting, in response to said determining step, a delay length of tubing to be fed past the sealing means in the event that a registration mark is detected by said detecting step, said delay length having a magnitude which is a function of the relative location of the detected registration mark and the window; and stopping the feeding of the tubing after said delay length of tubing has passed the sealing means to allow sealing of said tubing at that point.

62. The method of claim 61 wherein said setting step sets the magnitude of the delay length equal to a preset amount adjusted by the difference between the location of the detected registration mark and a target location within the window multiplied by a ratio of the preset amount to the magnitude of the total feed length before sealing and after the previous sealing.

63. The method of claim 62 wherein said setting step sets the preset amount equal to the delay length of a previous cycle of the system.

64. The method of claim 62 wherein said setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

65. The method of claim 64 wherein said setting step sets the predefined amount equal to the initial feed length of a previous cycle of the system.

66. The method of claim 62 wherein said setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

67. The method of claim 66 wherein said setting step sets the predefined amount equal to the initial feed length of a previous cycle of the system.

68. The method of claim 61 wherein said step of determining comprises processing by a central processing unit and said step of setting comprises counting by a counter loaded by the central processing unit and decremented as a function of feeding of the tubing.

69. In a method for sealing packages wherein a web of flexible packaging material having a series of registration marks is formed into tubing and fed past sealing means for sealing the tubing to form packages, an improved control method comprising the steps of:

feeding the tubing past the sealing means;

detecting the registration marks;

determining a difference between a target location and the detected location of a registration mark detected by said detecting step;

setting, in response to the determining step, a delay length of tubing to be fed past the sealing means in the event that a registration mark is detected by said detecting step, said delay length having a magnitude which is a function of the difference; and stopping the feeding of the tubing after said delay length of tubing has passed the sealing means to allow sealing of said tubing at that point.

70. The method of claim 69 wherein said setting step sets the magnitude of the delay length equal to a preset amount adjusted by the difference between the location of the detected registration mark and a target location within the window multiplied by a ratio of the preset amount to the magnitude of the total feed length before sealing and after the previous sealing.

71. The method of claim 70 wherein said setting step sets the preset amount equal to the delay length of a previous cycle of the system.

72. The method of claim 70 wherein said setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

73. The method of claim 72 wherein said setting step sets the predefined amount equal to the initial feed length of a previous cycle of the system.

74. The method of claim 69 wherein said setting step sets the magnitude of the initial feed length before the delay length and after the previous sealing equal to a predefined amount adjusted by the difference between the location of the detected registration mark and a target location within the window multiplied by a ratio of the predefined amount to the magnitude of the total feed length.

75. The method of claim 74 wherein said setting step sets the predefined amount equal to the initial feed length of a previous cycle of the system.

76. The method of claim 69 wherein said step of determining comprises processing by a central processing unit and said step of setting comprises counting by a counter loaded by the central processing unit and decremented as a function of feeding of the tubing.

* * * * *